US005181002A

United States Patent [19]

Sugiyama

[11] Patent Number: 5,181,002

[45] Date of Patent: Jan. 19, 1993

[54] ELECTROMAGNETIC SWITCH FOR STARTER

[75] Inventor: Takeshi Sugiyama, Hyogo, Japan

[73] Assignee: Mitsubishi Denki K.K., Tokyo, Japan

[21] Appl. No.: 813,513

[22] Filed: Dec. 26, 1991

[30] Foreign Application Priority Data

Dec. 28, 1990 [JP] Japan ..... 2-417244

[51] Int. Cl.[5] ..... H01F 7/08; H01H 50/60

[52] U.S. Cl. ..... 335/131; 335/278

[58] Field of Search ..... 335/131, 278, 126; 74/7 R, 7 A; 290/38 C, 48

[56] References Cited

U.S. PATENT DOCUMENTS 4,674,344 6/1987 Kazino et al. ..... 335/131

*Primary Examiner*—Harold Broome

*Attorney, Agent, or Firm*—Sughrue, Mion, Zinn, Macpeak & Seas

[57] ABSTRACT

An electromagnetic switch for a starter comprises a plunger made of elastic material such as rubber. The thickness of the flange portion is minimized and using a conventional core plate is deviated. The axial height of the rim of the front portion of the case into which is inserted the flange is decreased to produce the case by cold forging.

6 Claims, 2 Drawing Sheets

ELECTROMAGNETIC SWITCH FOR STARTER

BACKGROUND OF THE INVENTION

This invention relates to an electromagnetic (EM) switch for a starter, in which a plunger is moved backwardly by the switch being energized to cause a shift lever coupled to the plunger to pivot to close a circuit switch of an electric motor.

FIG. 3 is a sectional view of a conventional electromagnetic switch in which an exciting coil 1 is wound around a bobbin 2, and a fixed iron core 3 supports the bobbin 2. A case 4 holding the fixed iron core 3 functions as a yoke. A plunger 5 is slidably mounted on the front inner surface of the case 4 in the axial direction toward the core. A returning spring 6 biases plunger 5, and a sleeve bearing 7 is fixed on the front portion of the plunger 5 by caulking. A hook 8 has a rear portion thereof held in a bore of the plunger 5 and is slidable in the axial direction. The hook is formed of, for example, plastic, so that the front portion of the hook links with the top portion of a shift lever 24 to cause the lever to pivot. A compression spring 9 biases the hook 8 in a rearward direction.

A rod 10 projects from the rear end portion of the plunger 5, and is either formed integrally therewith or is fixed thereto. An insulation sleeve 11 has the rod movably inserted therein, and a moveable contact 12 is fixed to the rear end portion of the insulation sleeve 11 by an insulation washer 13 and a fixing ring 14. A compression spring 15 having a first end fixed to the plunger 5 and a second end is fixed to the insulation sleeve 11 to bias insulation sleeve 11 of the contact 12. An insulation cap 16 is fixed to the case 4 by caulking and abuts the rear end of the fixed iron core 3 through a rubber packing. A fixed contact terminal 17 is secured to the cap 16 in a position such that a first end of the terminal corresponds to the movable contact 12, and a second end is a terminal bolt 18 connected to a circuit terminal of the motor. A nut 19 and a switch terminal 20 are fixed to the insulation cap 16 to be connected to the lead wire 1*a* from the exciting coil 1.

A plunger cover 21 covers the front portion of the plunger 5, and has an inner cylindrical edge 21*a* fixed to the outer surface of the sleeve bearing 7. A flange 21*b* is inserted inwardly of a supporting rim 4*a*, and a projection 21*c* is inserted in an insertion hole 4*b* disposed on the case 4. A front bracket 22 of the motor is fixed to the electromagnetic switch by a bolt 23 so that the bracket 22 compresses the flange 21*b* of the plunger cover 21. As mentioned above, shift lever 24 has a top edge portion coupled to the hook 8, so that the shift lever 24 is pivoted by the sliding movement of the plunger 5, and a lower edge portion of the lever 24 causes an overrunning clutch (not shown) to slide. A rubber shield 25 is inserted in a notch in the bracket 22.

Looking at the plunger cover 21 in more detail, a sectional view of the interior of the plunger cover 21 is shown in FIG. 4(A). FIG. 4(B) is a sectional view along the B—B line of FIG. 4(B) showing the plunger cover. FIG. 4(C) is a sectional view of the exterior of the plunger cover and FIG. 4(D) is a sectional view along the D—D line of FIG. 4(A). The plunger cover includes a core plate 26 which is a thin metal disk plate to which a rubber member is heat-stacked (e.g., thermally fused) therearound to form the flange 21*b*. Two cylindrical projections 26*a* are formed at the inner surface of the core plate 26 by pressing. The rubber member is thermally fused to the inside of each cylindrical projection 26*a* to form the projection 21*c*. The insertion holes 21*d* positioned on the core plate 26 each have a bolt 23 inserted therethrough so that when the electromagnetic switch is mounted on the bracket 22, the bolt 23 penetrates through the thin rubber at the insertion holes 21*d*.

The operation of the above-described conventional EM switch is described hereinbelow with reference to the starter motor. When the exciting coil 1 is actuated, the plunger 5 is attracted to the fixed iron core 3. As a result, the hook 8 is slid backwardly to swing the shift lever 24 forwardly. After the hook 8 is slid backwardly by a predetermined amount, the movable contact 12 closes a pair of the fixed contacts 17 to start the rotation of the motor.

However, the above conventional EM switch has a problem in that the flange 21*b* of the plunger cover 21 includes the core plate 26 which results in a complicated and expensive structure. Furthermore, since the core plate 26 results in the flange 21*b* having a large thickness, the height (e.g., in the axial direction of the plunger) of the rim portion 4*a* of the case 4 must be increased (e.g., by about 3 mm). When the height of the rim portion 4*a* of the case is increased, the case manufacturing system cannot utilize a cold forging technique, but instead must utilize a machining processing. Accordingly, the manufacturing system becomes expensive.

SUMMARY OF THE INVENTION

Accordingly, an object of this invention is to eliminate the above-described problems of the conventional EM switch. More specifically, an object of the invention is to provide an electromagnetic switch for a starter, wherein the thickness of the flange of the plunger cover is reduced and is inexpensive, and wherein the case is efficiently and inexpensively produced.

The electromagnetic switch of the present invention is characterized by a flange portion of the plunger which does not include a core plate and which has a relatively small thickness and is formed solely by a rubber insulating material. Further, the height (in an axial direction of the case) of the rim of the case fixing the flange therein is reduced.

In the present invention, since the flange portion of the plunger cover is relatively thin (e.g., in the axial direction of the plunger) and is fixed to the relatively short rim at the top edge of the case, the electromagnetic switch is easily mounted on the front bracket. Furthermore, the plunger cover is easily produced because the core plate is not required. Additionally, the case is easily produced by cold forging because the rim of the front edge of the case is relatively short as compared to that of the conventional electromagnetic switch.

DETAILED DESCRIPTION OF THE PREFERRED EMBODIMENT

Figure 1:
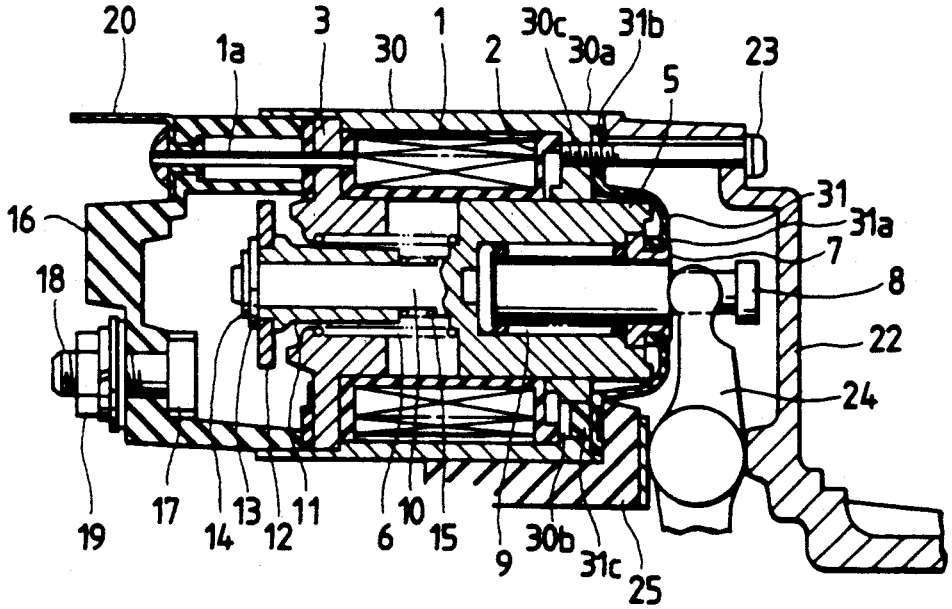
FIG. 1 is a sectional view illustrating an embodiment of a electromagnetic switch for a starter unit according to the present invention.
Figures 2A, 2B, 2C:
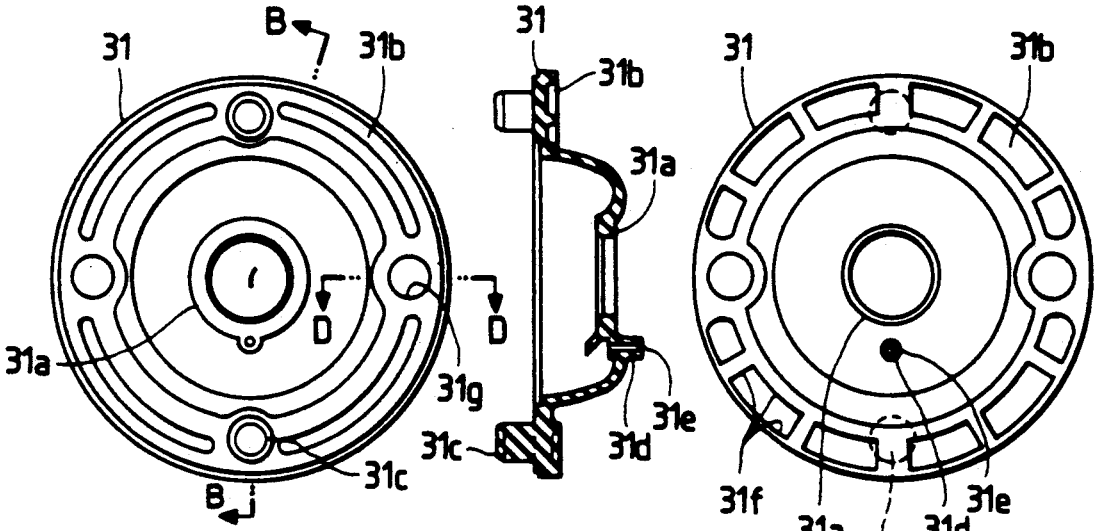
FIG. 2(A) is a sectional view of the interior of a plunger cover according to the embodiment shown in FIG. 1.
FIG. 2(B) is a sectional view of the plunger cover along the B—B line shown in FIG. 2(A)
FIG. 2(C) is a sectional view of the exterior of the plunger cover according to the embodiment shown in FIG. 1.
Figure 2D:
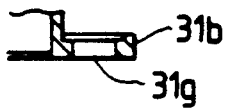
FIG. 2(D) is a sectional view of the plunger cover along the D—D line shown in FIG. 2(A)
Figure 3:
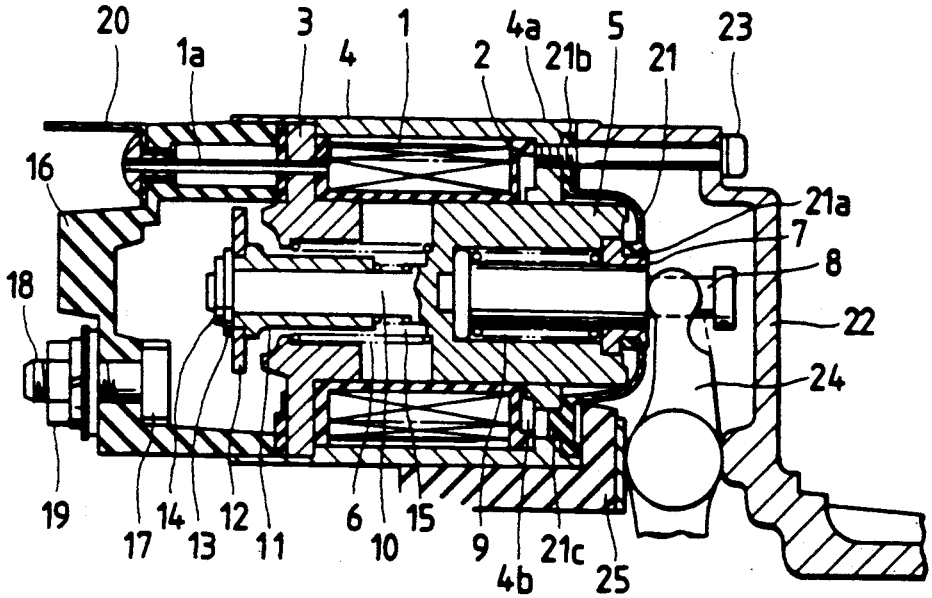
FIG. 3 PRIOR ART
FIG. 3 is a sectional view of an electromagnetic switch of a conventional starter unit.
Figure 4A:
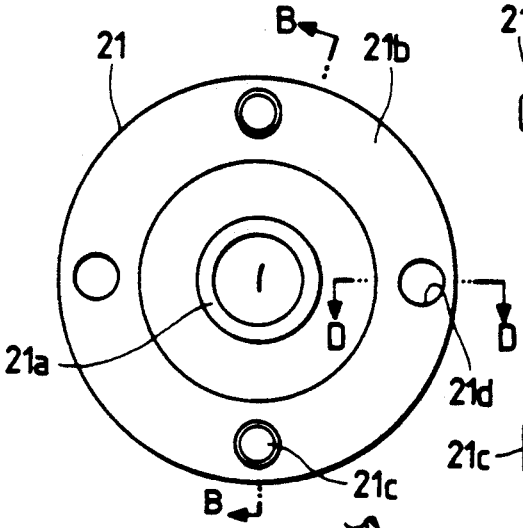
FIG. 4(A) PRIOR ART
FIG. 4(A) is a sectional view of the interior of a plunger cover according to the conventional EM switch shown in FIG. 3.
Figure 4B:
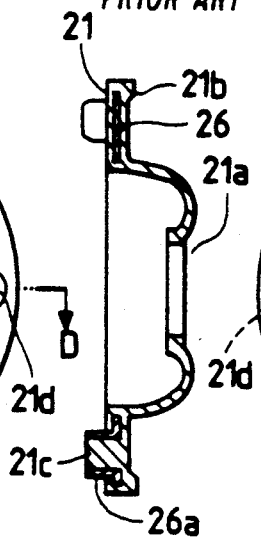
FIG. 4(B) PRIOR ART
FIG. 4(B) is a sectional view of the conventional plunger cover along the B—B line shown in FIG. 4(A)
Figure 4C:
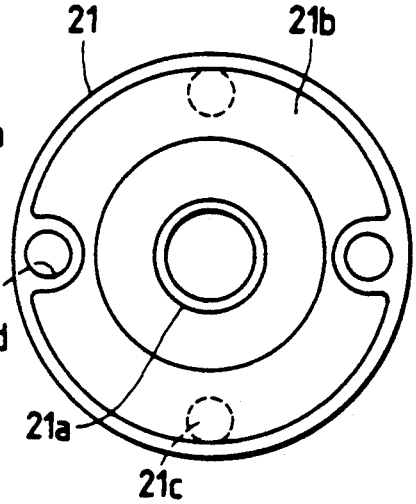
FIG. 4(C) PRIOR ART
FIG. 4(C) is a sectional view of the exterior of the plunger cover according to the conventional EM switch shown in FIG. 3.
Figure 4D:
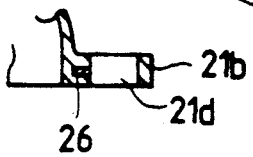
FIG. 4(D) PRIOR ART
FIG. 4(D) is a sectional view of the conventional plunger cover along the D—D line in FIG. 4(A).

One preferred embodiment of this invention will be described with reference to the accompanying drawings FIG. 1 is a sectional view showing an example of an electromagnetic switch for a starter unit according to the present invention. In FIG. 1, reference numerals 1-3, 5-20 and 22-25 designate the same components as those in FIG. 3 described above. The electromagnetic switch according to the invention comprises the same DC motor and starter unit (not shown) as the above-described conventional electromagnetic switch. A case 30 which functions as a yoke, has a rim 30*a* which has a relatively small thickness (about 1 mm) in the axial direction of the case, and which is positioned at the front portion of the case. A plunger cover 31 made of an elastic material such as rubber, has an inner edge portion 31*a* fixed to the outer surface of the sleeve bearing 7, and a flange portion 31*b* which is inserted in the rim 30*a* of the case 30 to contact the front surface of the case 30. A projection 31*c* of the plunger cover 31 projecting toward the interior of the case 30 is inserted through the insertion hole 30*b* of the case 30. The mounting bolt 23 which mounts the electromagnetic switch holding the plunger cover 31 to the front bracket 22, compresses the flange portion 31*b* of the plunger cover 31.

The plunger cover 31 is shown in greater detail in FIGS. 2(A)-2(D), and includes a ventilation projection 31*d* having a ventilation hole 31*e*. As shown in the figures, the plunger cover 31 is airtightly fixed on the front surface of the case 30, and the ventilation hole 31*e* freely maintains the air transfer by the sliding movement of the plunger 5 and prevents any obstruction of the plunger's movement. The ventilation hole 31 has a small diameter for preventing water intrusion. A rib 31*f* is disposed on the outside surface of the flange 31*b*. Two insertion holes 31*g* are disposed on the flange 31*b* relative to screw holes 30*b* for bolts disposed on the case 30. When the electromagnetic switch is mounted on the front bracket 22 by the mounting bolt above. The electromagnetic switch according to the invention comprises the same DC motor and starter unit (not shown) as the above-described conventional electromagnetic switch. A case 30 which functions as a yoke, has a rim 30*a* which has a relatively small thickness (about 1 mm) in the axial direction of the case, and which is positioned at the front portion of the case. A plunger cover 31 made of an elastic material such as rubber, has an inner edge portion 31*a* fixed to the outer surface of the sleeve bearing 7, and a flange portion 31*b* which is inserted in the rim 30*a* of the case 30 to contact the front surface of the case 30. A projection 31*c* of the plunger cover 31 projecting toward the interior of the case 30 is inserted through the insertion hole 30*b* of the case 30. The mounting bolt 23 which mounts the electromagnetic switch holding the plunger cover 31 to the front bracket 22, compresses the flange portion 31*b* of the plunger cover 31.

The plunger cover 31 is shown in greater detail in FIGS. 2(A)-2(D), and includes a ventilation projection 31*d* having a ventilation hole 31*e*. As shown in the figures, the plunger cover 31 is airtightly fixed on the front surface of the case 30, and the ventilation hole 31*e* freely maintains the air transfer by the sliding movement of the plunger 5 and prevents any obstruction of the plunger's movement. The ventilation hole 31 has a small diameter for preventing water intrusion. A rib 31*f* is disposed on the outside surface of the flange 31*b*. Two insertion holes 31*g* are disposed on the flange 31*b* relative to screw holes 30*b* for bolts disposed on the case 30. When the electromagnetic switch is mounted on the front bracket 22 by the mounting bolt 23, each of the bolts disposed on the case passes through the thin rim of the flange (e.g., shown in FIG. 2(D)) positioned over the respective insertion hole.

Since the rim 30*a* of case 30 is relatively short, the case 30 can be produced inexpensively and efficiently by cold forging.

As was described above, in the electromagnetic switch according to the invention, the plunger cover is made of elastic materials such as rubber, and the thickness of the flange thereof is relatively thin. Further, the rim disposed on the front portion of the case holding the flange is relatively short in the axial direction.

What is claimed is:

1. An electromagnetic switch supported by a bracket of a starter, comprising:

a cylindrical case having a plurality of insertion holes on a front edge surface thereof;

an exciting coil mounted on said case;

a plunger movably supported along an axis of said case on an inner surface of a first portion of said case;

a core mounted on said case, said plunger selectively movable between a first position and a second position, said plunger being attracted to said core and movable to said second position from said first position by excitation produced by said exciting coil;

a rod disposed at a rear portion of said plunger;

a movable contact supported at a rear edge of said rod and being insulated;

a fixed contact, disposed on said case, contacting said movable contact by movement of said plunger from said first position to said second position;

a hook having a portion thereof inserted in said plunger;

a sleeve bearing supporting said plunger and fixed to a front inner surface of said plunger;

a compression spring being positioned within said plunger, said hook being biased in a direction towards said fixed contact by said compression spring in said plunger;

a plunger cover comprising elastic material and covering a front surface of said plunger, said plunger cover including an inner circumferential edge portion fixed to an outer circumferential edge surface of said sleeve bearing, and a flange portion on an outer circumferential edge portion of said plunger cover tightly contacting a front edge surface of said case and a rear edge surface of said bracket, wherein said flange portion has a plurality of axial projections on an inside surface thereof; and wherein said axial projections are inserted in the insertion holes disposed on the front edge surface of said case, and said case includes an axially extending rim on its front circumference to enclose the outer circumference of said flange portion of said plunger cover.

2. An electromagnetic switch according to claim 1, wherein said plunger cover includes a ventilating projection having means for freely maintaining air transfer within said case resulting from sliding movement of the plunger.

3. An electromagnetic switch according to claim 1, further comprising a rib disposed on an outer surface of said flange portion.

4. An electromagnetic switch according to claim 1, wherein said plunger cover comprises rubber.

5. An electromagnetic switch according to claim 1, further comprising a mounting bolt for mounting the plunger cover to a front bracket of said starter.

6. An electromagnetic switch according to claim 1, wherein said plunger cover is fixed to the front edge surface of said case in an airtight manner.

* * * * *